United States Patent [19]

Chu

[11] 4,200,403

[45] Apr. 29, 1980

[54] WRITING IMPLEMENTS

[76] Inventor: David Y. Chu, Flat 14A Twinbrook, 43 Repulse Bay Rd., Hong Kong, Hong Kong

[21] Appl. No.: 943,468

[22] Filed: Sep. 18, 1978

[30] Foreign Application Priority Data

Apr. 21, 1978 [GB] United Kingdom ..... 15888/78

[51] Int. Cl.[2] ..... B43K 23/00; B43K 24/06; B43K 19/00; B43K 21/00

[52] U.S. Cl. ..... 401/6; 401/49; 401/55; 401/68; 401/77; 401/78; 401/99; 401/116

[58] Field of Search ..... 401/6, 49, 55, 53, 64, 401/87, 68-79, 99, 115, 116, 117, 131, 82, 292

[56] References Cited

U.S. PATENT DOCUMENTS

| | | | |
|---|---|---|---|
| 1,975,788 | 10/1934 | Harris | 401/76 |
| 2,338,068 | 12/1943 | Harris et al. | 401/75 |
| 2,633,827 | 4/1953 | Harris et al. | 401/74 X |
| 2,693,171 | 11/1954 | Lanoie | 401/75 X |
| 3,311,089 | 3/1967 | Vogel | 401/99 |

*Primary Examiner*—Edgar S. Burr
*Assistant Examiner*—Steven A. Bratlie
*Attorney, Agent, or Firm*—Donald D. Jeffery

[57] ABSTRACT

A writing implement having a body formed by a pair of leaves each having a longitudinally extending bore therein, with the bores in the two leaves coaxial and the two leaves interengaged in the manner of a hinge, and a writing member, such as a pencil lead or ball-point pen with an ink reservoir, extending through the coaxial bores in the two members, the two leaves being relatively pivotable about the axis of the coaxial bores therein between a storage configuration in which the leaves lie substantially in the same plane and a writing configuration in which the planes of the two leaves are at an acute angle to one another. The writing member is preferably secured to an axially movable plunger in the coaxial bores, which plunger has grooves co-operating with projections from the leaves such that a writing tip of the writing member is caused to project from one end of the leaves upon movement of the leaves from the storage to the writing configuration.

3 Claims, 6 Drawing Figures

WRITING IMPLEMENTS

The invention relates to writing implements.

A writing implement, to be reasonably comfortable to hold, needs to have a diameter in the region of eight to ten millimeters if the writer's fingers are not to become cramped unduly quickly. A writing implement of such a diameter however is likely to cause an unsightly bulge if placed in a pocket and is unsightly and/or can cause damage to the binding, if placed or clipped between the leaves of a diary, address or other book.

The invention has among its objects to provide a writing implement which can comfortably be held but which can be moved to a relatively flat configuration when not being used for writing.

According to the invention, a writing implement comprises a pair of leaves each having a longitudinally extending bore therein, the leaves being cut-away in a manner complementary to one another such that projecting portions of one leaf can engage in recesses in the other and vice versa with the bores in the two leaves coaxial in the manner of a hinge, and a writing member, such as a pencil lead or ball-point pen with an ink reservoir, extending through the coaxial bores in the two members, the two leaves being relatively pivotable about the axis of the coaxial bores therein between a storage configuration in which the leaves lie substantially in the same plane and a writing configuration in which the planes of the two leaves are at an acute angle to one another.

Such a writing implement can have a thickness in the storage configuration as small as three millimeters but when folded to the writing configuration can be comfortable for the writer to hold.

Advantageously the member housed in the coaxial bores of the leaves is axially movable therein and is moved axially therein, to cause a writing tip to project from one end of the leaves, by movement of the leaves from the storage configuration to the writing configuration.

Preferably an axially movable plunger is located in the bores at an opposite end of the writing implement to that from which the writing tip can project and has a mounting thereon whereby it can be secured to the pencil lead or ball-point pen reservoir in end-to-end relationship. Arcuate grooves are provided in the peripheral wall of the plunger, the grooves being arcuate in the sense that they extend partly longitudinally and partly peripherally along and around the plunger, and co-operating projections are provided on the leaves and extend into the respective bore thereof each to engage in a respective one of the grooves such that relative pivotal movement of the leaves causes the projections to move along the grooves and thus cause longitudinal movement of the plunger and therefore of the pencil lead or ball-point pen reservoir engaged therewith.

A clip may be provided on one or other of the leaves whereby the writing implement can be clipped into a pocket. Markings may be provided adjacent the edge of one or both of the leaves which is remote from the portion having the bore therein such that the writing implement can be used as a rule or ruler, a minature slide-rule can be built into a surface of one or other of the leaves and some surfaces of the leaves may bear advertising matter, conversion tables or other written matter.

The invention is diagrammatically illustrated by way of example in the accompanying drawing, in which.

Figure 1:
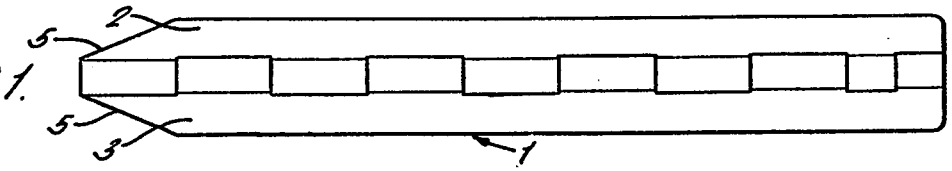
FIG. 1 is a plan view of a writing implement according to the invention in a storage configuration.

Referring to the drawings a writing implement generally indicated at 1 comprises a pair of leaves 2 and 3 each having an outer configuration of generally keyhole-shape, that is to say each having a portion of generally circular outline integral with a portion of strip outline, as shown parallel sided strip outline, the portion of generally circular outline having a bore 4 therein. The edge portion of each leaf 2, 3 having the bore therein is castellated, the castellations of one leaf beng complementary to the castellations of the other leaf such that the two leaves can interengage with the bore 4 in one leaf coaxial with the bore 4 in the other leaf. At one end the leaves are tapered at 5 such that the width of the combined leaves 2, 3 at that end is equal to the outside diameter of the keyhole portion of each leaf.

Figure 4:
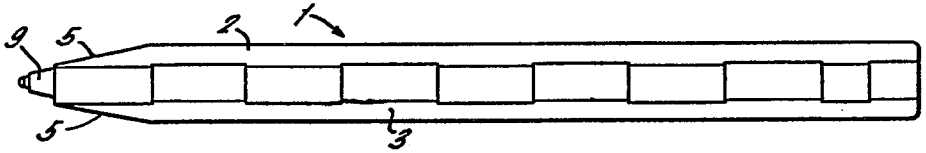
FIG. 4 is a plan view of the pen of FIG. 1 in a writing configuration.

A plunger 6 is located in the other end of the combined bore 4 and at its inner end has a socket or spigot 7 whereby it can be coupled in end-to-end relationship with a co-operating spigot or socket of a writing member 8. A writing tip 9 of the writing member 8 can be seen in FIG. 4. As shown the tip 9 is of a ball-point pen, the remainder of the writing member 8 then being formed as an ink reservoir.

Arcuate slots 10 and 11 are provided in the peripheral wall of the plunger 6 and co-operate with projecting portions 12 and 13 respectively provided respectively in the bores 4 of the leaves 2 and 3. The grooves 10 and 11 each extend both longitudinally and peripherally of the plunger 6.

Figure 2:
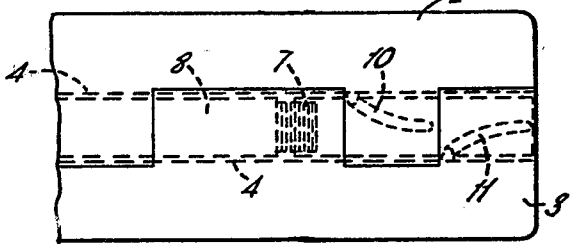
FIG. 2 is a view to a larger scale corresponding to the righthand portion of FIG. 1.
Figure 3:
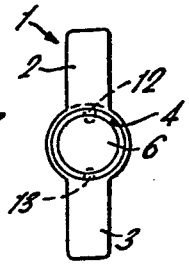
FIG. 3 is an end view corresponding to FIG. 2.
Figure 5:
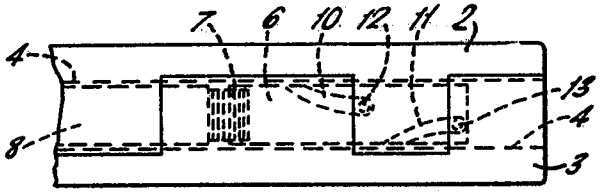
FIG. 5 is a view to a greater scale of the righthand portion of FIG. 4.
Figure 6:
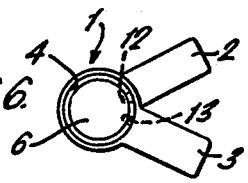
FIG. 6 is an end view corresponding to FIG. 5.

In the storage configuration of FIGS. 1 to 3, the leaves 2 and 3 extend in diametrically opposite directions from the bore 4. In the writing configuration of FIGS. 4 to 6, the leaves 2 and 3 have been pivoted each through an angle of approximately 62° in opposite directions such that they lie at an acute angle to one another to give the overall section of the writing implement a generally V-shape. This is the limiting position of movement of the leaves with respect to one another since in this position a portion of one leaf at the junction line between the circular portion and the strip portion thereof abuts a similar portion of the other leaf.

The pivoting movement of the leaves 2 and 3 causes the projection 12 to move the full length of the groove 10 and the projection 13 to move the full length of the groove 11 thereby moving the plunger 6 axially with respect to the leaves 2 and 3 to cause the writing tip 9 of the writing member 8 to project from the tapered end 5 of the writing implement 1.

The outside diameter of the portions of generally circular outline of the leaves 2 and 3 is preferably in the region of three millimeters whereby the writing implement 1, in the storage configuration of FIGS. 1 to 3, can be placed between the leaves of a book without significant risk of damage to the binding thereof or can be stored flat in a pocket of the user. In the writing configuration of FIGS. 4 to 6 the overall V-shape gives the writing implement sufficient dimensions for it to be comfortably held by the user.

The plunger 6 for moving the writing member coaxially within the coaxial bores 4 of the leaves can be replaced by other means for this purpose or may be omitted altogether and the tip 9 of the writing implement arranged to project permanently from the leaves 2 and 3.

What is claimed is:

1. A writing implement comprising a pair of leaves each formed to have a longitudinally extending bore therein, said leaves being cut-away in a manner complementary to one another such that projecting portions of one of said leaves can engage in recesses in the other of said leaves and vice versa with said bores in said two leaves coaxial in the manner of a hinge, and a writing member extending through said coaxial bores in said two members, said two leaves being relatively pivotable about the axis of said coaxial bores between a storage configuration in which said leaves lie substantially in the same plane and a writing configuration in which the planes in which said two leaves lie are at an acute angle one to the other.

2. A writing implement as claimed in claim 1, wherein said writing member housed in said coaxial bores of said leaves is axially movable in said bores and is moved axially therein, to cause a writing tip of said writing member to project beyond one end of said leaves, by movement of said leaves from said storage configuration of said writing configuration.

3. A writing implement as claimed in claim 2, wherein an axially movable plunger is located in said bores at an opposite end of said leaves to said one end and has a mounting thereon whereby it can be secured to said writing member in end-to-end relationship, arcuate grooves are provided in the peripheral wall of said plunger, the grooves being arcuate in the sense that they extend partly longitudinally and partly peripherally along and around said plunger, and co-operating projections are provided on said leaves and extend into the respective said bore thereof each to engage in a respective one of said grooves such that relative pivotal movement of said leaves causes said projections to move along said grooves and thus cause longitudinal movement of said plunger and said writing member with respect to said leaves.

* * * * *